US007422212B2

(12) United States Patent
Noll, Jr. et al.

(10) Patent No.: US 7,422,212 B2
(45) Date of Patent: Sep. 9, 2008

(54) TRANSFER WHEEL

(75) Inventors: Harry C. Noll, Jr., Whitehall, PA (US); Mike L. White, Nazareth, PA (US)

(73) Assignee: Graphic Management Associates, Inc., Allentown, PA (US)

( * ) Notice: Subject to any disclaimer, the term of this patent is extended or adjusted under 35 U.S.C. 154(b) by 117 days.

(21) Appl. No.: 11/454,534

(22) Filed: Jun. 16, 2006

(65) Prior Publication Data

US 2007/0001381 A1 Jan. 4, 2007

Related U.S. Application Data

(60) Provisional application No. 60/692,696, filed on Jun. 21, 2005.

(51) Int. Cl.
*B65H 29/00* (2006.01)

(52) U.S. Cl. ..... 271/307; 271/306; 271/244; 271/277

(58) Field of Classification Search ..... 271/204, 271/277, 306, 307

See application file for complete search history.

(56) References Cited

U.S. PATENT DOCUMENTS

| | | | |
|---|---|---|---|
| 4,434,979 | A | 3/1984 | Kobler et al. |
| 4,629,175 | A | 12/1986 | Fischer et al. |
| 5,452,886 | A | 9/1995 | Cote et al. |
| 5,611,530 | A | 3/1997 | Maresse et al. |
| 6,182,960 | B1 | 2/2001 | Keller et al. |
| 6,698,742 | B2 | 3/2004 | Hansch |

FOREIGN PATENT DOCUMENTS

| | | |
|---|---|---|
| EP | 0 408 902 A1 | 6/1990 |

*Primary Examiner*—Kaitlin S Joerger
(74) *Attorney, Agent, or Firm*—Lucas & Mercanti, LLP

(57) ABSTRACT

A transfer wheel removes flat products from one location, such as an overhead conveyor, spaces the products apart, reorients them and then transfers the products to a second conveyor or other location. The transfer wheel is eccentrically mounted within a circular frame. Grippers mounted on radially-moving spokes of the transfer wheel rotate as the wheel turns, to reorient the products, for example from vertical to horizontal, so they can be laid flat on the second conveyor. The eccentric mounting of the wheel causes the spokes to increase the spacing between adjacent products as the wheel turns, to prepare the products for later processing.

8 Claims, 10 Drawing Sheets

TRANSFER WHEEL

CROSS REFERENCE TO RELATED APPLICATION

This application is entitled to the benefit of U.S. Provisional Patent Application Ser. No. 60/692,696, filed Jun. 21, 2005. Such application is incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to a device for transferring flat, flexible products from one location, such as a conveyor, to another location. The invention is especially useful for transporting newspapers between two conveyors and reorienting them for later feeding to a bagging machine.

2. Art Relating to the Invention

In the graphic arts industry, flat, flexible, printed products, such as newspapers and magazines, are often moved from one processing machine, such as an inserter, to another machine or location by line conveyors having grippers. The product is typically carried in a vertical, hanging orientation, one product per gripper. At some point along the path, the product has to be transferred from the line conveyor to another conveyor or other location, for later transport to a bagging or other machine for further processing. Very high transport speeds are necessary.

Typically, a line conveyor, as employed in the graphic arts industry, is a horizontally oriented endless chain that is equipped with a plurality of vertically oriented grippers moving overhead of other machines. The grippers clamp the top edge of the product and transport the product along. When the product arrives at its destination, the gripper opens its jaws to allow the product to fall or be removed from the conveyor to another area.

For proper handling by a bagging machine, the vertically hanging products on the overhead line conveyor need to be reoriented into a horizontal position and laid on another conveyor or other device in a serial or "singulated" arrangement, namely one product after another, flat and in single file. The spacing distance between adjacent products is also important. At present, for newspaper products, the spacing between each adjacent singulated product needs to be approximately fourteen inches, for proper, high-speed bagging to take place. However, the spacing between the vertically hanging products on the line conveyor is normally less than that, such as six inches or so, because a shorter spacing is needed to help maximize product flow speed along the conveyor.

Thus, a need exists for a high-speed transfer device that effectively (1) removes vertically oriented products from a line conveyor; (2) orients the products horizontally; (3) increases the spacing between the products; (4) singulates the products; and (5) transfers the products to another conveyor or other area for subsequent proper handling by a bagging machine or other processing machine.

SUMMARY OF THE INVENTION

It has now been discovered that, by employing a transfer wheel invention that operates as a circular gripper conveyor, a smooth and rapid transfer of the product occurs from the overhead line conveyor to an underneath singulating conveyor. The transfer wheel is eccentrically mounted within a circular frame. Movable grippers mounted on movable and pivotable spokes of the transfer wheel rotate as the wheel turns, to serially grab the products from an overhead line conveyor, space them apart, reorient them, and then deposit them flat on the singulating conveyor beneath the wheel. For example, the products can be reoriented from a vertical position to a horizontal position.

The outside ends of the spokes are attached to sliders that slide along a track or groove formed in the circular frame. As the transfer wheel rotates, the sliders continuously push and pull the spokes out and in radially, due to the eccentric mounting of the wheel. When the spokes move out, the outside ends of the spokes move apart, thus increasing the spacing distance between adjacent grippers (and their gripped products) as the wheel turns. In this way, the transfer wheel, which may also be referred to as a "singulating gripper wheel," properly orients and spaces apart the products, and then transfers them serially to the singulating conveyor, which then transports them away to a wrapping or bagging machine or other processing area.

More particularly, in one embodiment, the present invention comprises a device for transferring flat products from a first location to a second location, comprising:

a wheel rotatably mounted between said first location and said second location; and a plurality of movable grippers mounted to the wheel around its periphery;

whereby, as the wheel rotates, each gripper grips one of said products from the first location, increases a spacing distance between adjacent gripped products, and moves each product serially to the second location.

In another embodiment, the present invention comprises a transfer wheel device for transferring, spacing apart and reorienting a plurality of flat, flexible, vertically-oriented products from a first conveyor to a second conveyor, comprising:

a rotatable transfer wheel mounted eccentrically within a circular frame, below said first conveyor and above said second conveyor;

a plurality of bearing blocks pivotally mounted to the transfer wheel around its periphery;

an approximately radially-oriented spoke slidably held within each of said bearing blocks; and a movable gripper mounted to a slider attached to an outside end of each spoke;

whereby, as the transfer wheel rotates, each gripper serially grips one of said products from the first conveyor, increases a spacing distance between adjacent gripped products, reorients each product to an approximately horizontal position, and deposits each product serially on the second conveyor.

BRIEF DESCRIPTION OF THE DRAWINGS

These and other aspects of the present invention may be more fully understood by reference to one or more of the following drawings, in which.

DETAILED DESCRIPTION OF THE INVENTION

In the present application, reference is made to newspaper jackets or, more simply, jackets, as the flat, flexible, printed product. Each newspaper within the jacket typically contains a number of loose inserts. It will be understood that other products besides newspapers can be handled by the present invention. In addition, while the present invention is particularly useful for positioning newspapers on a conveyor or other device for proper transportation to a wrapping or bagging machine, it will be understood that the invention may also be used to transport flat products to other processing machines or locations.

Figure 1:
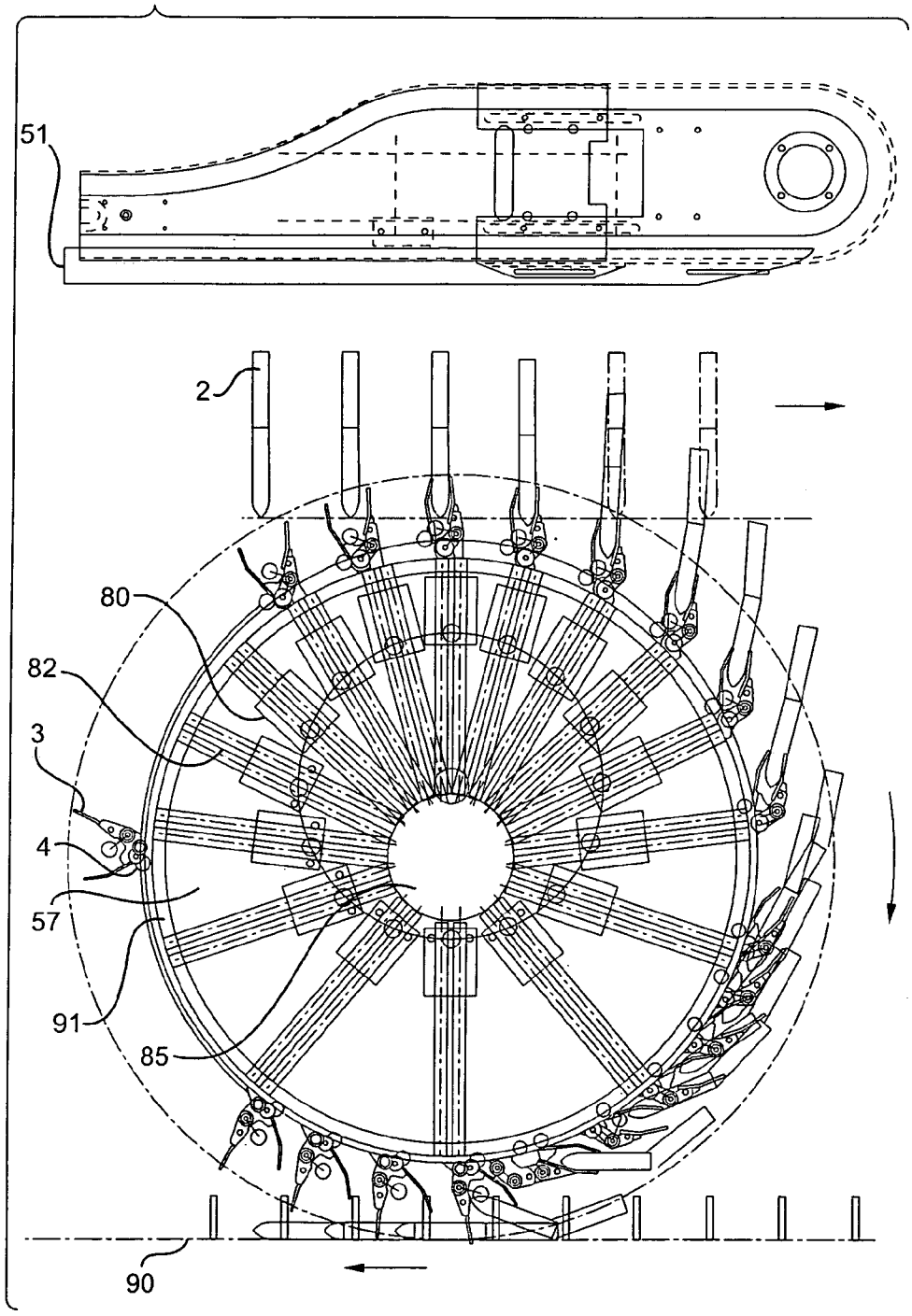
FIG. 1 is a side view of the transfer wheel of the present invention.

FIG. 1 illustrates a preferred embodiment of the present invention. One general mechanical principle employed in the invention is that of a slider crank mechanism. In a feature of the invention, a circular, rotatable transfer wheel 85 is eccentrically mounted within a circular frame 57. Transfer wheel 85 is preferably comprised of two metal disks mounted to each other, parallel to each other, slightly spaced apart and having a common axis of rotation. This arrangement is best seen in FIGS. 2-5.

Figure 6:
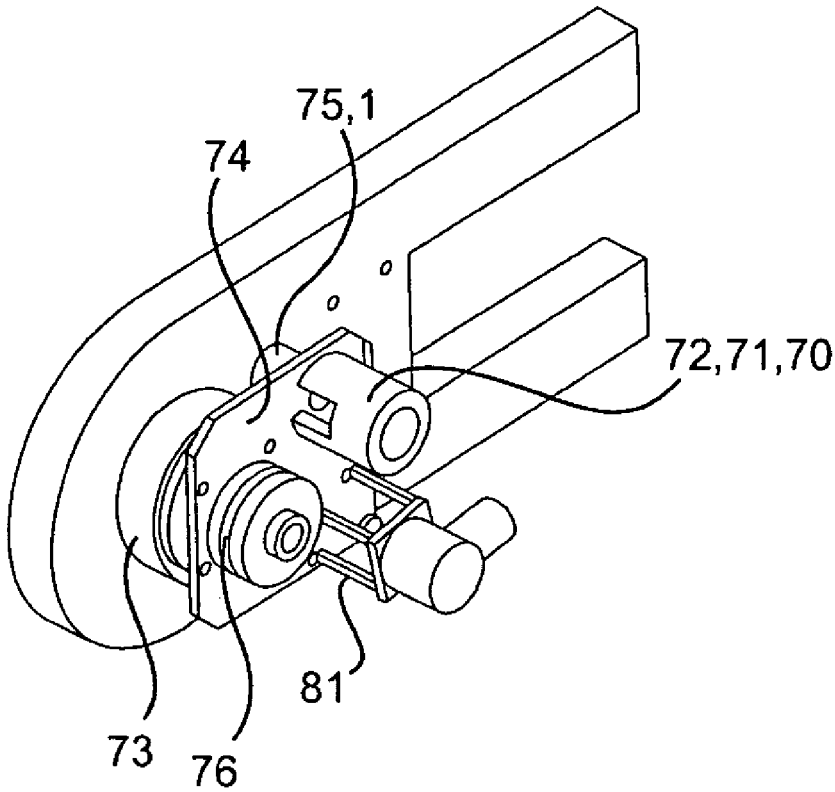
FIG. 6 is a side view of a machine incorporating an alternative embodiment of the transfer wheel of the invention, the machine being shown positioned near a feeder of an insert machine, underneath a linear gripper conveyor, and over a wrapping or bagging machine.

In the illustrations of FIGS. 1 and 2-5, the wheel is arranged to rotate clockwise by a motor (not shown) driving gears, chains or a belt. If desired, the belt can be driven from the overhead gripper conveyor, as can be seen in FIG. 6. The axis of rotation of wheel 85 is preferably offset away from the imaginary center of circular frame 57, and is preferably closer to the top of circular frame 57 than to the bottom. The degree of eccentricity in the mounting may be varied depending upon the amount of spacing that is desired between products as the wheel turns (discussed below).

In a preferred embodiment, transfer wheel 85 is positioned below a line conveyor 51, and above a singulating conveyor 90. Line conveyor 51 has a plurality of line conveyor grippers (not shown) that hold jackets 2 of a newspaper in a vertical, hanging orientation. Typically, the newspaper will be folded, with the folded, closed side on the bottom to prevent inserts from falling out. In the illustration of FIG. 1, the jackets 2 are moved by line conveyor 51 toward the right. Singulating conveyor 90 moves toward the left. In FIG. 1, it can be seen that jackets 2 are lying horizontal on conveyor 90. Conveyor 90 can be used to transport the newspapers to a wrapping or bagging machine.

Transfer wheel 85 is operated in synchronization with line conveyor 51 and singulating conveyor 90, to ensure that the circumferential speed of the grippers 3 on the wheel is the same as the linear speed of the products 2 moving along the conveyors 51 and 90.

In another feature of the invention, and as shown in FIGS. 1 and 2-5, pivotally mounted between the disks of transfer wheel 85 and around its periphery are a plurality of bearing blocks 80, which function somewhat like hollow articulating joints. In the present embodiment, 16 bearing blocks are employed, and they are spaced equally apart around the circumference of wheel 85.

Figure 2:
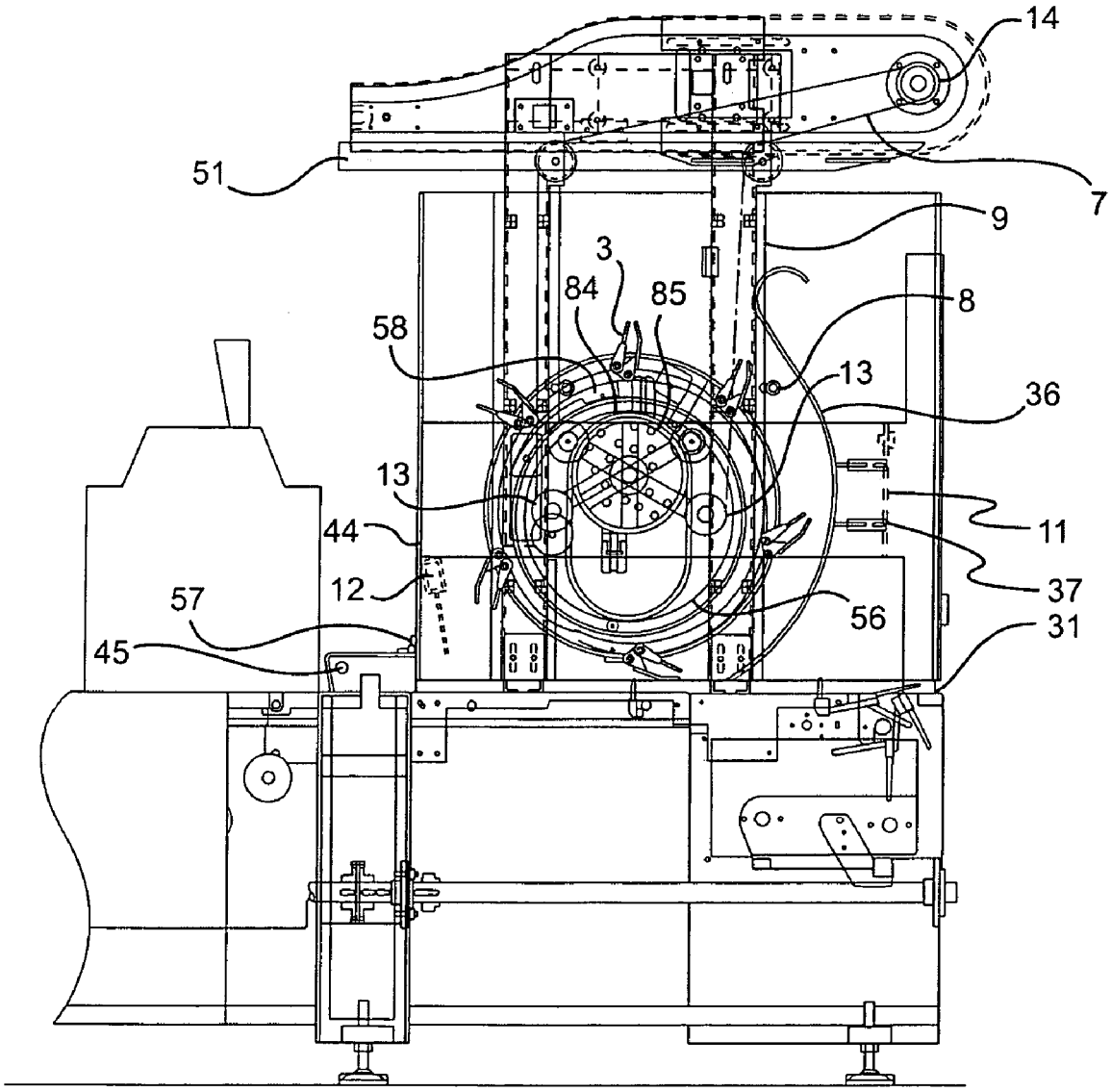
FIGS. 2-5 are a series of perspective, simplified views of the transfer wheel of FIG. 1, showing a time sequence of operations of elements of the wheel as the wheel rotates clockwise through four positions.
Figure 3:
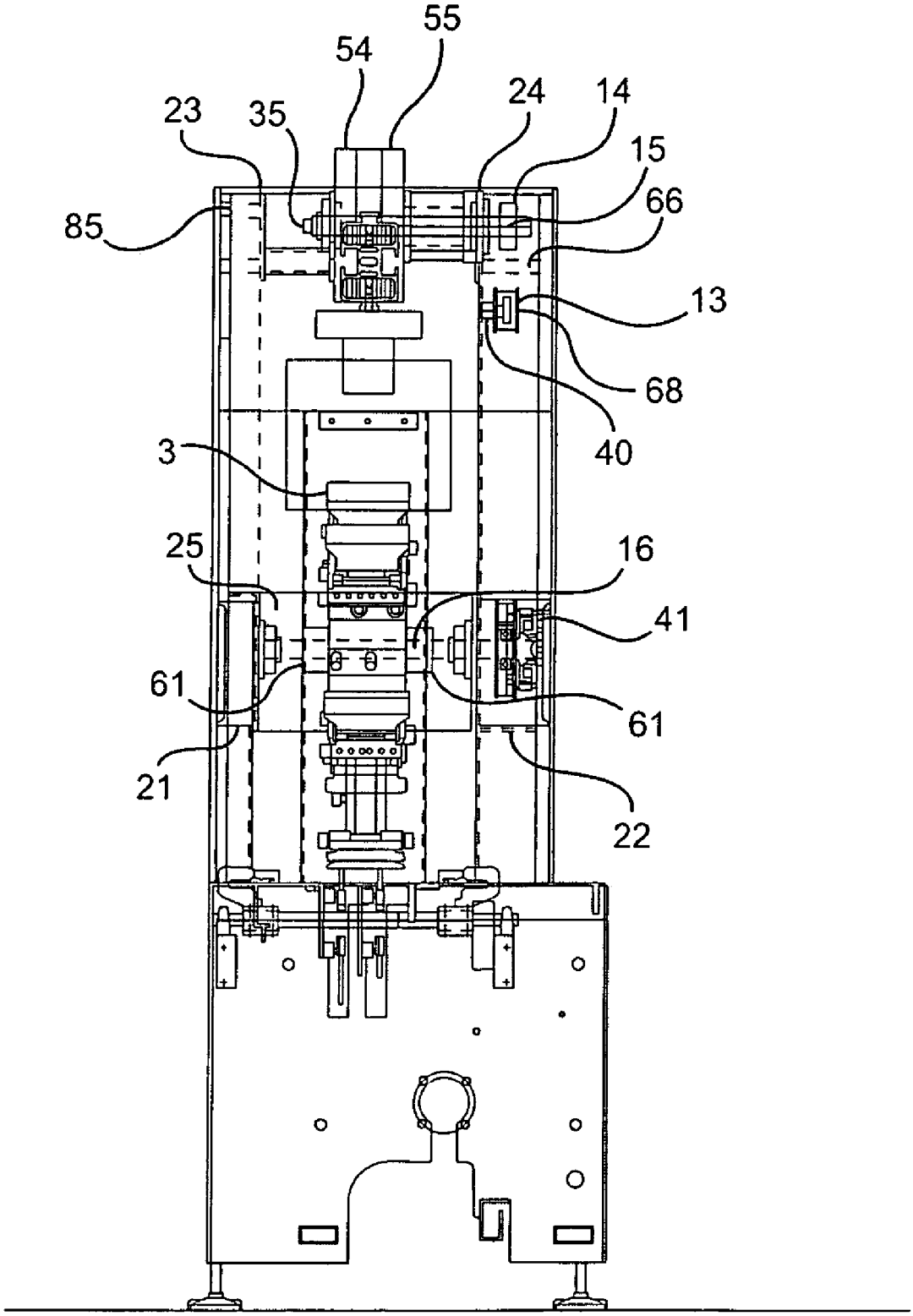
Figure 4:
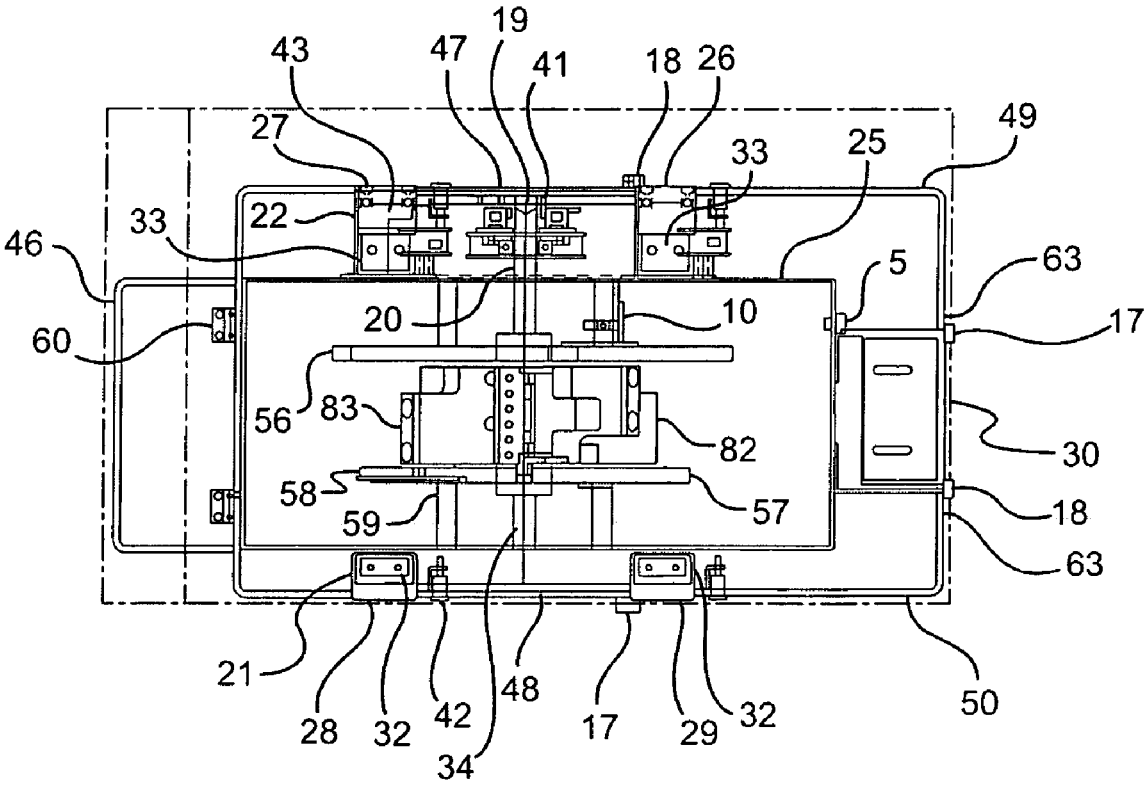
Figure 5:
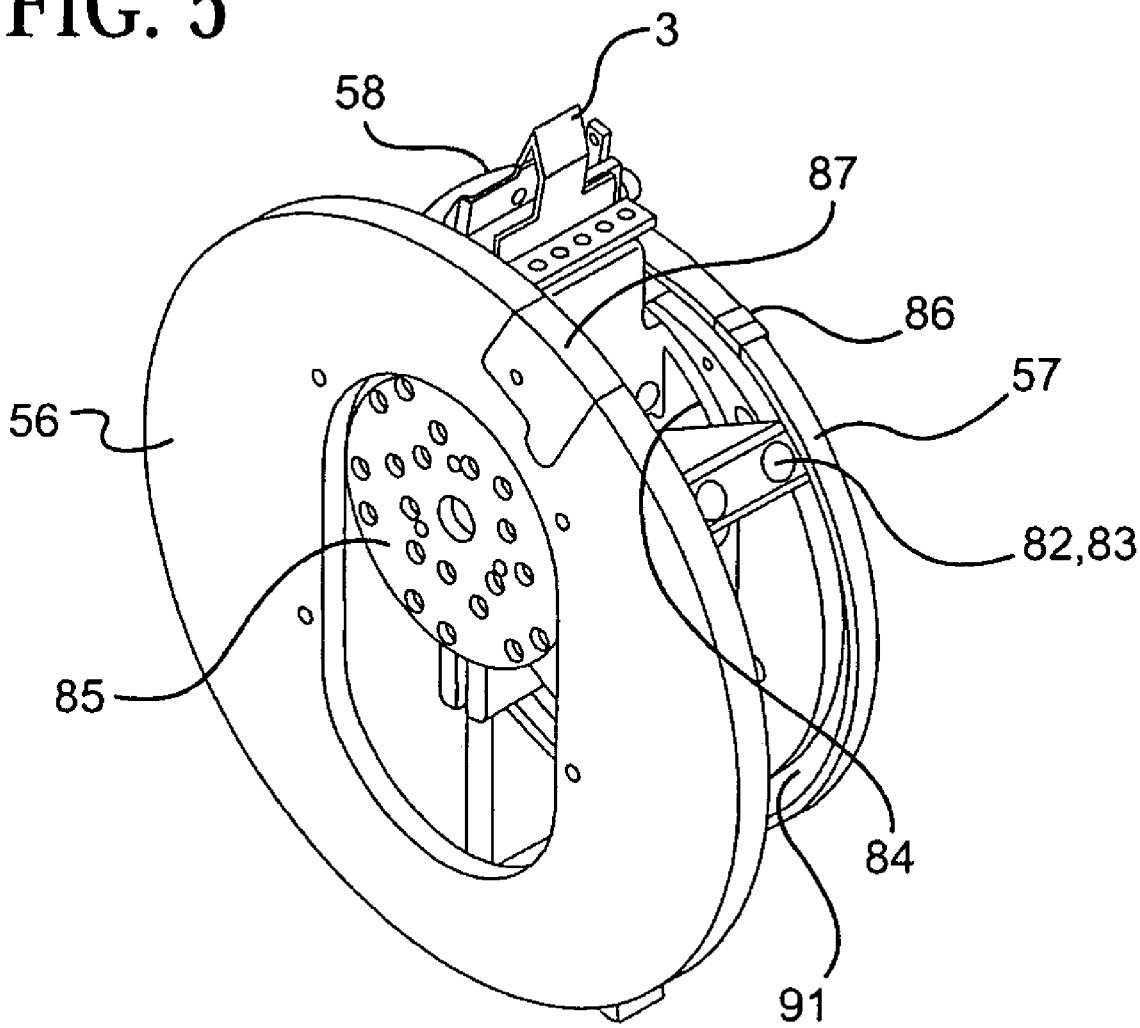

Slidably mounted within each bearing block 80 is a spoke 82. The outer end of each spoke is attached to a slider 4, which is best seen in FIG. 3. The inner end of each spoke is unattached. Each slider 4 is slidably mounted within a track or groove 91 that is formed around the periphery of circular frame 57, as shown in FIGS. 1, 2 and 3. In this arrangement, the spokes 82 assume an approximately radial orientation, pointing toward the imaginary center of circular frame 57.

Attached to each slider 4 is a movable gripper 3. Each gripper 3 has two jaws that are spring biased in a closed position. Cams are used to open the jaws. Opening cams (not shown), positioned at the top and bottom of circular frame 57, are employed for opening the jaws to grab a product 2 from above and release the product below.

In yet another feature of the invention, each gripper 3 is rotatable. For example, as seen in FIG. 1, the jaws of the grippers at the top, bottom and left side of the circular frame 57 are facing away from transfer wheel 85, whereas the jaws of the grippers on the right side of frame 58 have rotated to the left, in a direction opposite to the direction of rotation of the transfer wheel 85. Typically, the grippers will rotate by approximately 90 degrees. This changes the orientation of the product from vertical to horizontal after the product has rotated approximately halfway around the wheel.

In order to help control the movement of jacket 2 during its downward decent from line conveyor 51 to singulating conveyor 90, a curved guide (see FIG. 6) is mounted slightly away from the right side periphery of circular frame 57. As will be appreciated, each gripper 3 grabs the bottom edge of a jacket 2, and the guide helps maintain the top edge of jacket 2 in an upward-facing direction during its downward movement. This assists in preventing inserts, which are in jacket 2, from escaping.

The operation of the invention will now be described, with reference to FIGS. 1 and 2-5. As previously mentioned, transfer wheel 85 is rotating clockwise in these particular figures. When a gripper 3 has rotated directly under a product 2, the jaws of the gripper close. Approximately simultaneously, the jaws of the line conveyor gripper (not shown) that are holding the product open to release the product.

As transfer wheel 85 continues to rotate, and as best seen in FIG. 3, slider 4 is sliding along track 91. Since transfer wheel 85 is eccentrically mounted in relation to track 91, the distance between track 91 and bearing block 80 gradually and continuously increases as the wheel rotates around its right-hand portion, and the slider 4 starts to pull its associated spoke outwardly away from the wheel. Bearing block 80 also starts to pivot gradually. These actions cause the distance between adjacent grippers to increase, which is best seen by comparing FIG. 4 with FIG. 3. This, in turn, causes the spacing between adjacent gripped products to increase.

Meanwhile, a cam mechanism (see FIG. 10) attached to each gripper causes the jaws of the gripper to rotate counterclockwise, away from the direction of rotation of wheel 85. This action, together with the guide 36 (FIG. 2), changes the movement of the product from left to right to clockwise circular, and eventually changes the orientation of the product from vertical to horizontal.

When a gripped product on the transfer wheel rotates into a position directly over the singulating conveyor 90, after approximately one-half of a rotation of the wheel, the jaws of gripper 3 open, and the product is released onto conveyor 90. The released products are now appropriately flat, singulated, separated from each other by the correct distance, and ready to be rapidly and effectively processed by a bagging machine or other processing machine. Typically, the products hanging from the overhead gripper conveyor will be spaced apart by approximately 6 inches. In a preferred embodiment, the present invention will increase the spacing between products to approximately 14 inches.

An alternative embodiment of the present invention is shown in FIGS. 6-10. More particularly, FIG. 6 is a side view of a machine incorporating an alternative embodiment of the transfer wheel of the invention, the machine being shown positioned near a feeder of an insert machine, underneath a linear gripper conveyor, and over a wrapping or bagging machine.

Figure 7:
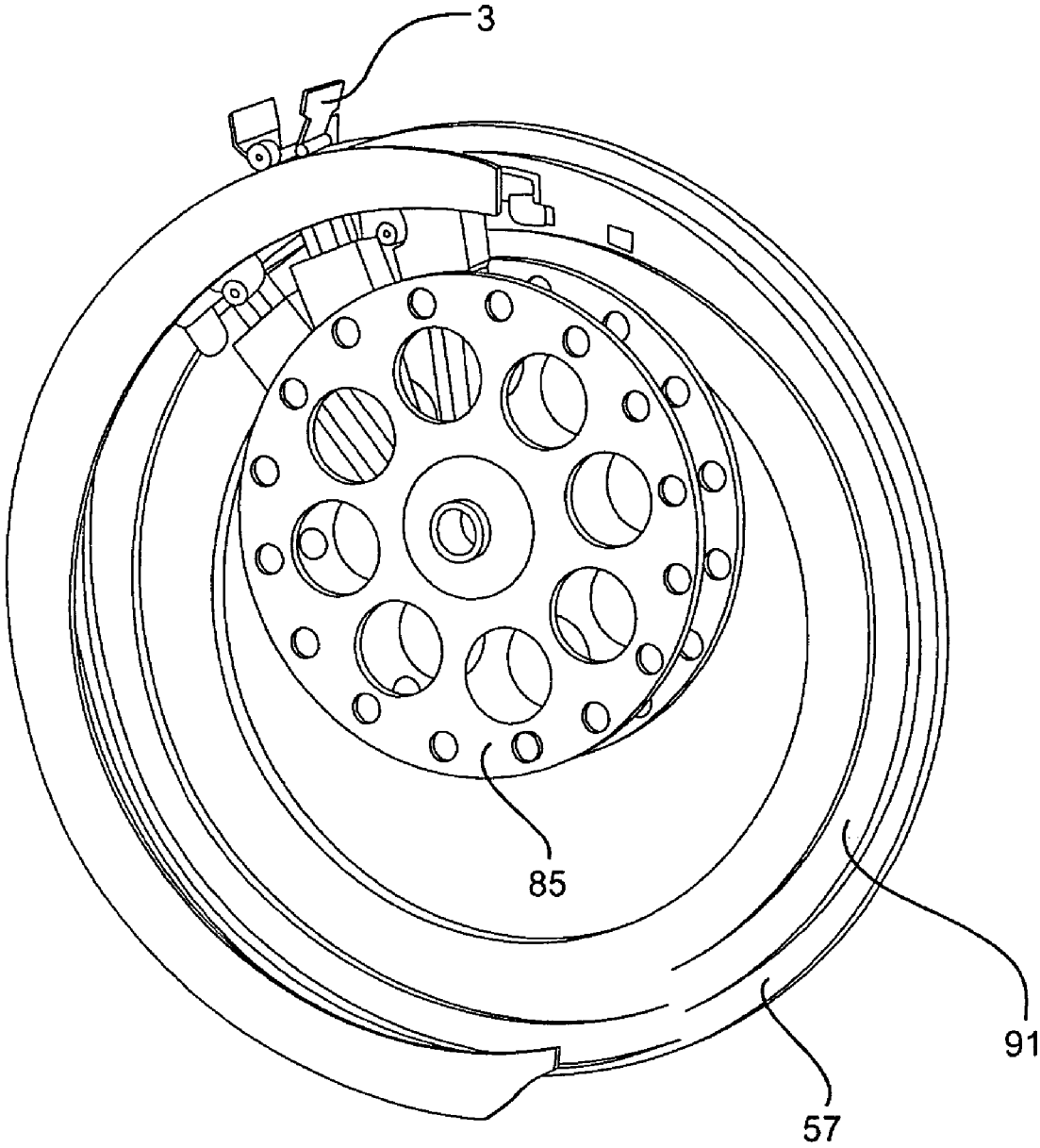
FIG. 7 is a front view of the machine of FIG. 6.
Figure 8:
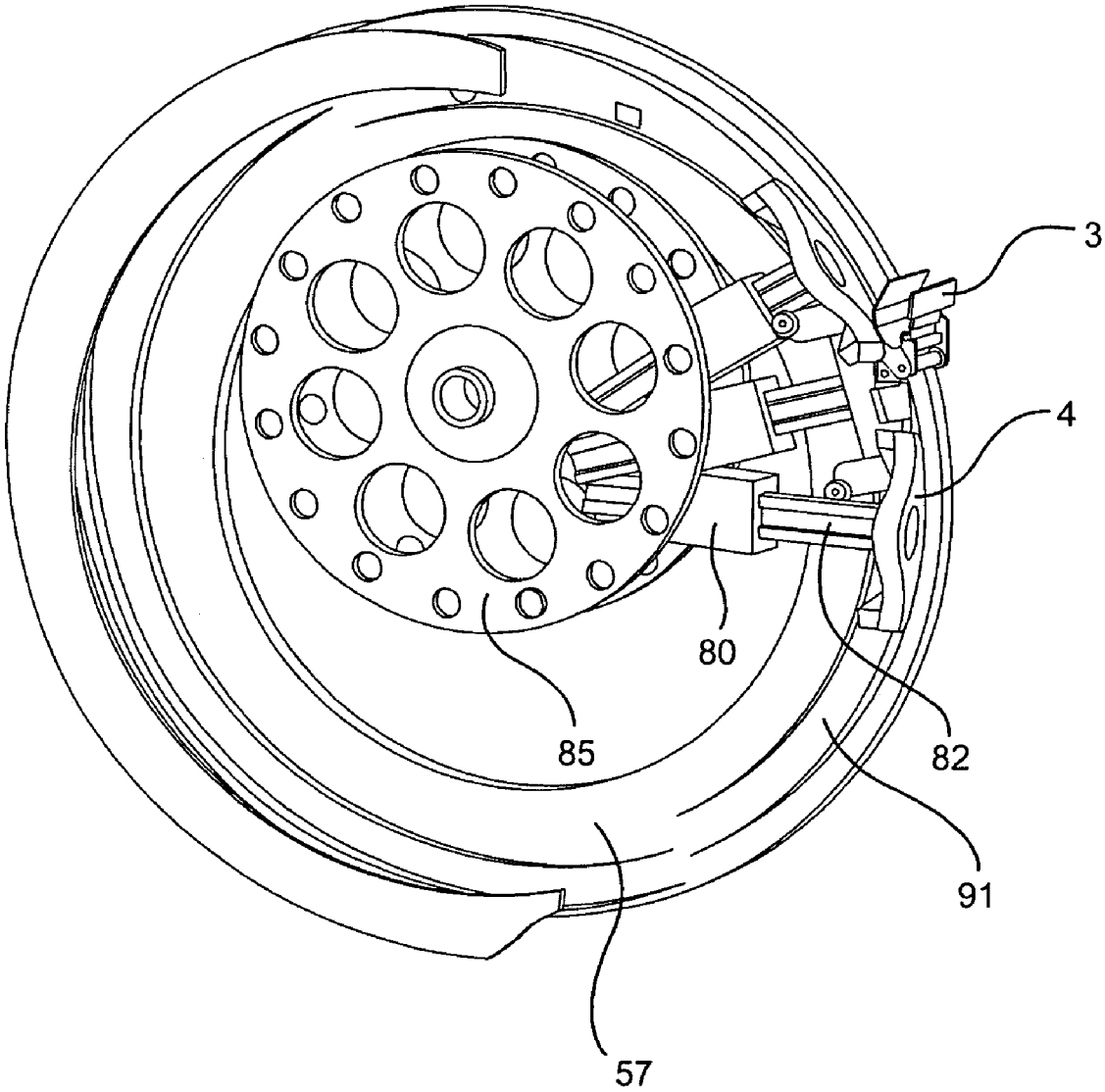
FIG. 8 is a top view of the machine of FIG. 2.
Figure 9:
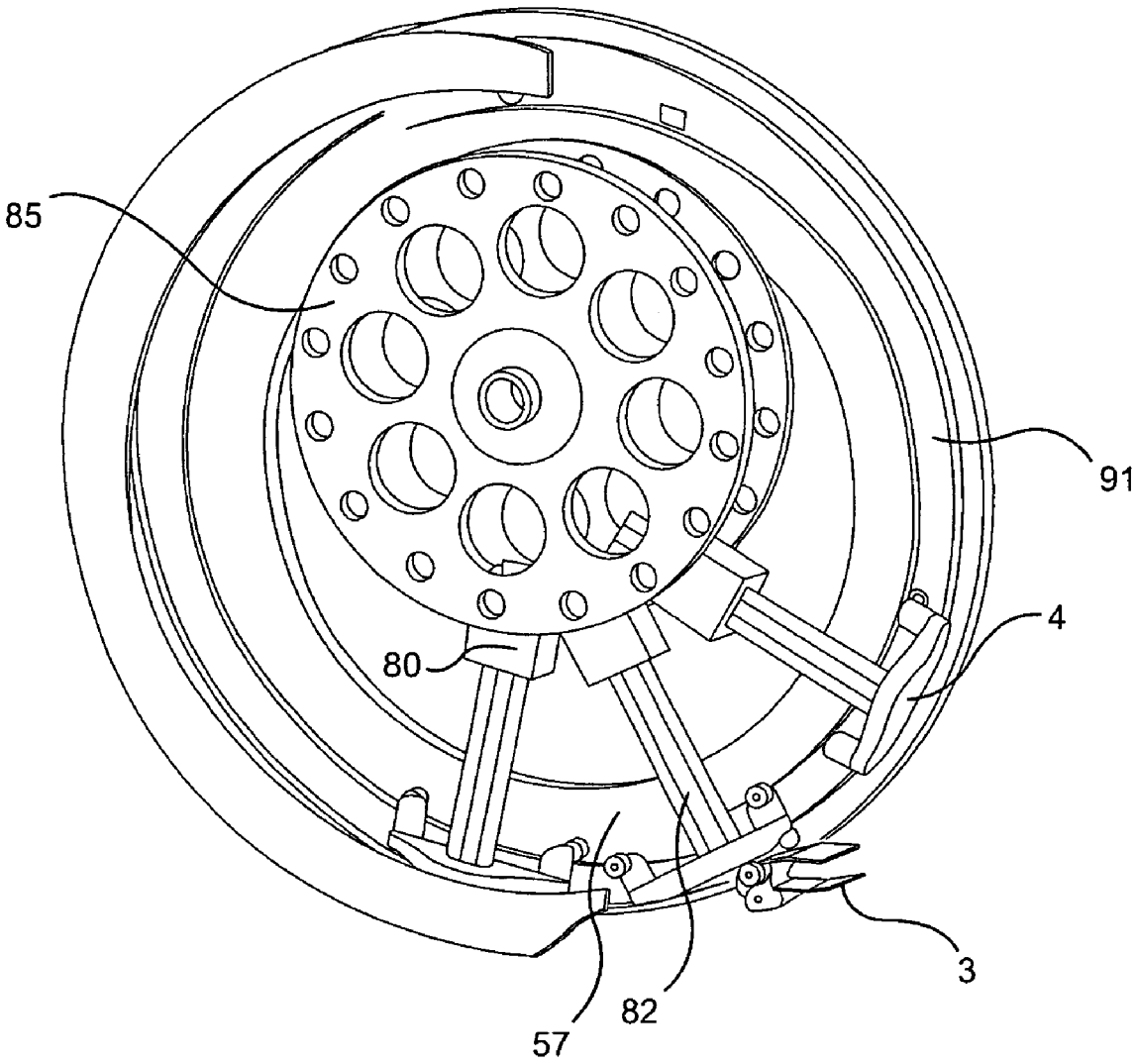
FIG. 9 is a simplified perspective view of the transfer wheel shown in FIG. 6.
Figure 10:
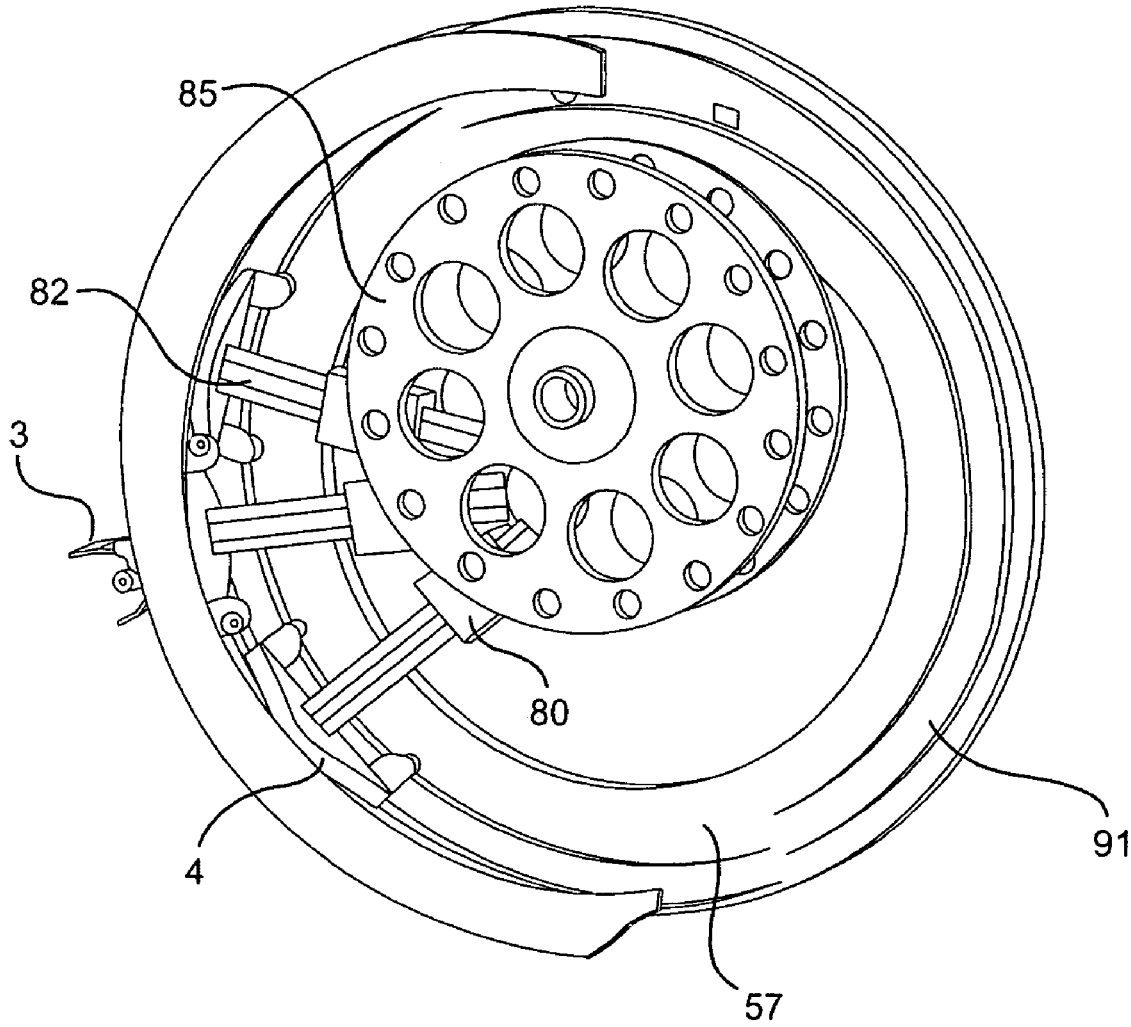
FIG. 10 is a simplified perspective view of a gripper cam mechanism used with the transfer wheel shown in FIG. 6.

FIG. 7 is a front view of the machine of FIG. 6; FIG. 8 is a top view of the machine of FIG. 6; FIG. 9 is a simplified perspective view of the transfer wheel shown in FIG. 6; and FIG. 10 is a simplified perspective view of a gripper cam mechanism used with the transfer wheel shown in FIG. 6.

This alternative embodiment is different from the previously-described embodiment in that the spokes are fixed, whereas the spokes 82 of FIGS. 1 and 3 pivot as the wheel rotates. Also, the grippers around the wheel of this embodiment are spaced farther apart than the grippers of the previously-described embodiment.

While only a limited number of specific embodiments of the present invention have been expressly disclosed, it is, nonetheless, to be broadly construed and not to be limited except by the claims appended hereto.

What is claimed is:

1. A device for transferring flat products from a first location to a second location, comprising:

a singular transfer wheel rotatably mounted between said first location and said second location; and a plurality of movable grippers mounted to the wheel around its periphery;

whereby, as the wheel rotates, each gripper grips one of said products from the first location, increases a spacing distance between adjacent gripped products, and moves each product serially to the second location.

2. The device of claim 1, wherein said products are newspapers.

3. The device or claim 1, wherein the first location is a first conveyor and the second location is a second conveyor.

4. The device of claim 1, in which each gripper is rotatably mounted to the wheel.

5. The device of claim 1, in which each product is reoriented from a first position to a second position as the wheel rotates.

6. The device of claim 5, in which the first position is a vertical position and the second position is a horizontal position.

7. A transfer wheel device for transferring, spacing apart and reorienting a plurality of flat, flexible, vertically-oriented products from a first conveyor to a second conveyor, comprising:

a rotatable transfer wheel mounted eccentrically within a circular frame, below said first conveyor and above said second conveyor;

a plurality of bearing blocks pivotally mounted to the transfer wheel around its periphery;

an approximately radially-oriented spoke slidably held within each of said bearing blocks; and a movable gripper mounted to a slider attached to an outside end of each spoke;

whereby, as the transfer wheel rotates, each gripper serially grips one of said products from the first conveyor, increases a spacing distance between adjacent gripped products, reorients each product to an approximately horizontal position, and deposits each product serially on the second conveyor.

8. The device of claim 6 wherein said products are newspapers.

* * * * *